US008758672B2

(12) United States Patent
Nitzl et al.

(10) Patent No.: US 8,758,672 B2
(45) Date of Patent: Jun. 24, 2014

(54) SUBMERGED ENTRY NOZZLE

(75) Inventors: Gerald Nitzl, Bocholt (DE); John Davies, Warwickshire (GB)

(73) Assignee: Refractory Intellectual Property GmbH & Co KG, Vienna (AT)

( * ) Notice: Subject to any disclaimer, the term of this patent is extended or adjusted under 35 U.S.C. 154(b) by 276 days.

(21) Appl. No.: 12/998,842

(22) PCT Filed: Jan. 21, 2009

(86) PCT No.: PCT/GB2009/000143
§ 371 (c)(1),
(2), (4) Date: Jul. 8, 2011

(87) PCT Pub. No.: WO2010/084295
PCT Pub. Date: Jul. 29, 2010

(65) Prior Publication Data

US 2011/0315721 A1 Dec. 29, 2011

(51) Int. Cl.
*B22D 41/08* (2006.01)

(52) U.S. Cl.
USPC ..... 266/217; 222/602; 222/603

(58) Field of Classification Search
USPC ..... 266/217; 222/602, 603
See application file for complete search history.

(56) References Cited

U.S. PATENT DOCUMENTS

| | | | | |
|---|---|---|---|---|
| 4,108,339 | A * | 8/1978 | Lunde | 222/591 |
| 4,531,567 | A | 7/1985 | Gruner et al. | |
| 5,858,260 | A * | 1/1999 | Daussan et al. | 222/602 |

FOREIGN PATENT DOCUMENTS

| | | | |
|---|---|---|---|
| EP | 0 771 601 | A1 | 5/1997 |
| GB | 201 853 | A | 8/1923 |
| GB | 1 270 024 | A | 4/1972 |
| WO | WO 02/081123 | A2 | 10/2002 |

* cited by examiner

*Primary Examiner* — Scott Kastler
(74) *Attorney, Agent, or Firm* — Nixon & Vanderhye, P.C.

(57) ABSTRACT

Nozzle for guiding molten metal, including an inlet at an upstream first end, at least one outlet towards a downstream second end, and an inner surface between the inlet and the outlet defining a bore through the nozzle having a throat region adjacent the inlet. An annular channel is provided in the inner surface of the nozzle, and a fluid supply is arranged to introduce fluid into the bore via the annular channel or downstream thereof. The throat region has a convexly curved surface and the annular channel is located within or adjacent the convexly curved surface of the throat region.

15 Claims, 10 Drawing Sheets

SUBMERGED ENTRY NOZZLE

This application is the U.S. national phase of International Application No. PCT/GB2009/000143 filed 21 Jan. 2009 which designated the U.S., the entire contents of each of which are hereby incorporated by reference.

FIELD OF THE INVENTION

This invention relates to a nozzle for guiding molten metal, for example molten steel. More particularly, the invention relates to a so-called submerged entry nozzle (SEN), also known as a casting nozzle, used in a continuous casting process for producing steel. The invention also relates to a system for controlling a flow of molten metal, for example, when casting steel.

BACKGROUND TO THE INVENTION

In a continuous casting steel-making process, molten steel is poured from a ladle into a large vessel known as a tundish. The tundish has one or more outlets through which the molten steel flows into one or more respective moulds. The molten steel cools and solidifies in the moulds to form continuously cast solid lengths of metal. A submerged entry nozzle is located between the tundish and each mould, and guides molten steel flowing through it from the tundish to the mould. The submerged entry nozzle has the form of an elongate conduit and generally has the appearance of a rigid pipe or tube.

An ideal submerged entry nozzle has the following main functions. Firstly, the nozzle serves to prevent the molten steel flowing from the tundish into the mould from coming into contact with air since exposure to air would cause oxidation of the steel, which adversely affects its quality. Secondly, it is highly desirable for the nozzle to introduce the molten steel into the mould in as smooth and non-turbulent a manner as possible. This is because turbulence in the mould causes the flux on the surface of the molten steel to be dragged down into the mould (known as 'entrainment'), thereby generating impurities in the cast steel. A third main function of a submerged entry nozzle is to introduce the molten steel into the mould in a controlled manner in order to achieve even solidified shell formation and even quality and composition of the cast steel, despite the fact that the steel solidifies most quickly in the regions closest to the mould walls.

It will be appreciated that designing and manufacturing a submerged entry nozzle which performs all of the above functions to an acceptable degree is an extremely challenging task. Not only must the nozzle be designed and manufactured to withstand the forces and temperatures associated with fast flowing molten steel, but the need for turbulence suppression combined with the need for even distribution of the molten steel in the mould create extremely complex problems in fluid dynamics.

Furthermore, it is common to introduce aluminium into the casting process in order to combine with and thereby remove any oxygen from the molten steel—since oxygen may form undesirable bubbles or voids within the cast metal. However, it is well known that the resulting alumina tends to accumulate on the inner surface—of submerged entry nozzles employed during the casting process. This build up restricts the flow of metal through the nozzle, which, in turn, affects the quality and flow of metal exiting the nozzle. In time alumina build up may eventually completely block the flow of metal thereby rendering the nozzle unusable.

It is therefore an object of the present invention to provide an improved submerged entry nozzle.

SUMMARY OF THE INVENTION

In accordance with a first aspect of the present invention there is provided a nozzle for guiding molten metal comprising: an inlet at an upstream first end; at least one outlet towards a downstream second end; an inner surface between said inlet and said at least one outlet defining a bore through the nozzle; the bore having a throat region adjacent the inlet; an annular channel being provided in the inner surface of the nozzle; and a fluid supply means being arranged to introduce fluid into the bore via the annular channel or downstream thereof; wherein the throat region has a convexly curved surface and the annular channel is located within or adjacent the convexly curved surface of the throat region.

It will be understood that, since the annular channel is located within or adjacent the convexly curved surface of the throat region (i.e. at the interface between the convexly curved surface and the remainder of the bore), the inner surface of the nozzle immediately upstream of the annular channel will be curved.

The Applicants have found that the present invention allows the introduction of a fluid, such as argon, into the bore of the nozzle with minimal disruption to molten metal flowing through the nozzle. The Applicants believe this is because the curved surface of the throat region provides a tangential lift-off surface, which encourages the molten metal to detach from the inner surface of the nozzle prior to the introduction of the fluid through the annular channel. However, unlike in the case of a frusto-conical throat region, where the molten metal is directed towards the centre of the nozzle and creates turbulence in the bore, in the present case the molten metal remains substantially in laminar flow and continues in a generally curved, downwardly direction when detached from the inner surface. Accordingly, the geometry of the nozzle prior to the annular channel affects the flow of metal and thereby the effectiveness of the fluid which is introduced by the annular channel. With the present invention the fluid can be introduced to form a curtain (i.e. layer) between the inner surface of the nozzle and the molten metal flowing therethrough, as described in detail below. This helps to prevent inclusions from depositing along the bore which in turn can affect the flow characteristics of the molten metal exiting the nozzle.

In use, this particular nozzle construction therefore allows molten metal to flow into the throat region until it is thrown off the inner surface of the nozzle due to the presence of the annular channel, which may be regarded as a discontinuity in the inner surface. This creates a 'dead zone' in the region of the annular channel where substantially no metal flows. Downstream of the 'dead zone' the flow of metal naturally tends to expand and would re-attach itself to the inner surface of the nozzle if it were not for the fluid introduced via the fluid supply means. It will therefore be understood that the fluid supply means is positioned to introduce fluid into this 'dead zone' prior to re-attachment of the metal to the inner surface of the nozzle. The fluid fed into the bore in the region of the 'dead zone' is brought down the inner surface of the bore by the flow of molten metal therethrough. Thus, the fluid forms a sleeve or curtain between the bore and the flow of metal, which helps to prevent the metal from re-attaching to the inner surface of the nozzle and thereby reduces the build-up of inclusions such as alumina on the inner surface of the nozzle. In some embodiments, the length of the curtain can be made to oscillate in order to provide a scrubbing effect to minimise the build-up of inclusions. Since the fluid is introduced into a 'dead zone' it can be introduced at a lower rate and pressure than if it were to be introduced directly into the stream of metal. Accordingly, substantial savings can be made on the amount of fluid required.

The Applicants have performed Computational Fluid Dynamics (CFD) modelling to study the effect of having a frusto-conically shaped throat region 10 in a nozzle 12 which would otherwise fall within the above definition of the present invention. The results of these studies are shown in FIG. 1 in the form of sequential phase distribution maps for the first few seconds after a gas 14 is introduced via an annular channel 16 (which is disposed within the throat region 10), while molten metal 18 is flowing through the nozzle 12. More specifically, FIG. 1 shows twenty-three views of the phase distribution within the nozzle 12, with each consecutive view (when viewed from left to right) illustrating the phase distribution 1 second after the previous view. Note, FIG. 1A shows an enlarged view of the throat region of the first view in FIG. 1, which illustrates the phase distribution when the gas 14 is first introduced into the bore (i.e. when time lapsed is effectively 0 seconds).

In this particular study (as for the comparative studies described later), a simple open-ended nozzle 12 (i.e. having an axial outlet of equal diameter to the bore) was employed. Thus, within the nozzle 12 molten metal 18 was allowed to freefall under gravity—the control of flow through the nozzle 12 being solely achieved by the degree of closure of the stopper rod 20. Accordingly, the modelling results could apply equally to other arrangements of outlet ports, which could be chosen according to the flow characteristics desired in the mould.

With reference to FIG. 1 it can be seen that argon gas 14 injected via the annular channel 16 does not form a protective curtain down the sides of the nozzle 12 but instead it forms discrete pockets of gas 14 along the length of the bore. Accordingly, with a frusto-conical throat 10 there is no tendency for a gas curtain to be formed on the inner surface of the nozzle 12 and the Applicants believe that this is because the straight sides of the throat region 10 direct the molten metal 18 towards the centre of the nozzle 12 and this causes a degree of turbulence in the molten metal 18 which in turn disturbs the gas 14 flowing into the bore.

Referring back to the present invention, the nozzle is intended to be used in a system incorporating a stopper rod for controlling the flow of molten metal (as described above). The throat region of the nozzle has a seating surface, which receives the stopper rod in use. The distance between the stopper rod and the seating surface can be varied to control the flow of molten metal through the nozzle. The annular channel may be positioned downstream of the seating surface.

The nozzle may be of the type known as a submerged entry nozzle. Thus, the nozzle may be formed from a single piece of monolithic refractory.

Alternatively, the nozzle may be formed from two or more discrete components. For example, a so-called inner nozzle or a tundish nozzle may form an upper portion of the nozzle, when in use, and a so-called submerged entry shroud (SES) or a monotube nozzle may form a lower portion of the nozzle, when in use. In some embodiments, the upper portion may include the convexly curved throat region at an upstream end thereof and the upper portion may terminate with a transversely flanged annular plate provided a relatively short distance from the downstream end of the throat region. The lower portion may include a corresponding transversely flanged annular plate at an upstream end thereof, which is arranged to be clamped to the annular plate of the upper portion to secure the two portions together. The majority of the bore of the nozzle may be provided by the lower portion. The above embodiment may be employed in a stopper-controlled tube changer system or in the case where the SES or monotube is changed manually. A particular advantage of such an embodiment is that the fluid introduced into the bore via the annular channel can form a barrier to prevent air ingress into the bore at the junction between the two components.

In certain embodiments, the nozzle is arranged to transport molten metal from a tundish to a mould.

The channel may be provided either entirely within the throat region (in which case the inner surface of the nozzle immediately downstream of the channel will be curved) or it may be provided at the interface of the throat region and the remainder of the bore.

The curved surface immediately upstream of the channel may have a tangential plane that forms an angle of between 0° and a theoretical maximum of 90° when measured with respect to the longitudinal axis of the bore. Thus, theoretically, the tangential plane may be parallel to the axis, 0°, (in which case the radius of the curved surface immediately upstream of the channel is perpendicular to the nozzle axis), perpendicular to the axis, 90°, (in which case the radius of the curved surface immediately upstream of the channel is parallel to the nozzle axis), or it may intersect the axis at any angle therebetween so as to form a cone which is open in an upstream direction. In some practical embodiments, the tangential plane may form an angle of between 0° and 50°, between 0° and 30°, between 0° and 5°, between 5° and 20°, or between 5° and 10°, when measured with respect to the longitudinal axis of the bore. Alternatively, the tangential plane may form an angle of 45° with respect to the longitudinal axis of the bore.

The width of the channel (i.e. its dimension along the length of the bore) may be short or may extend as far as the at least one outlet or the second end of the nozzle (i.e. the diameter of the bore at all positions downstream of the upstream wall of the channel is greater than the diameter of the bore immediately upstream of the channel). More particularly, the width of the channel may be within a range of approximately 0.5% to 95% of the distance between the first and second ends of the nozzle. In certain embodiments, the width of the channel is no more than 60% of the distance between the first and second ends of the nozzle. In other embodiments, the width of the channel is no more than 30% of the distance between the first and second ends of the nozzle. In yet further embodiments, the width of the channel is no more than 10% of the distance between the first and second ends of the nozzle. In still further embodiments, the width of the channel is no more than 5% of the distance between the first and second ends of the nozzle. It will be understood that the maximum width of the channel will be governed by the position of the channel within the nozzle. For example, where the channel is positioned at 10% of the distance from the first end to the second end, the maximum extent of the channel will be 90% of the distance between the first and second ends.

The depth of the channel (i.e. its radial extent) may be within a range of approximately 0.1% to 50% of the thickness of the nozzle at the point immediately upstream of the channel.

The cross-sectional profile of the channel is not particularly limited and it may, for example, be semi-spherical, square, triangular (e.g. V-shaped), U-shaped or any other polygonal form. Accordingly, the channel may be defined by wall portions of the bore which are curved or straight, or a combination thereof. In addition, the wall portion at the upstream end of the channel may extend generally towards the second end of the nozzle, towards the first end of the nozzle or parallel to the first and second ends.

Although the channel may be fully annular (i.e. extend completely along the inner surface of the bore) the required functional effect of lifting the metal from the inner surface of the nozzle might still be achieved or partially achieved with one or more discontinuities in the channel (i.e. an embodiment is contemplated in which the channel is constituted by a number of mutually spaced part-annular channels). In such cases, the sum of the spacings between channels will be less than 50%, preferably less than 35%, more preferably less than 20% and most preferably less than 15% of the sum of the channel lengths.

The fluid supply means may comprise at least one passageway (preferably a plurality of passageways) extending through a side of the nozzle to the channel or to a portion of the inner surface downstream of the channel. The fluid supply means may comprise a porous block which constitutes at least one wall portion of the channel or a portion of the inner surface downstream of the channel and which is configured to diffuse fluid therethrough.

In particular embodiments, the fluid supply means is configured to supply a gas such as argon into the bore.

The throat region may, for example, have an axial extent of 3 to 10% (e.g. approximately 5%) of the distance between the first and second ends of the nozzle.

The at least one outlet may be axially aligned or inclined to the longitudinal axis of the bore.

The diameter of the bore of the nozzle downstream of the channel may be greater than, equal to or less than the diameter of the bore in the region of the channel. In one embodiment, the diameter of the bore downstream of the channel is less than the diameter of the bore in the region of the channel but greater than the diameter of the bore immediately upstream of the channel.

At least one recess may be provided in the bore. The at least one recess may have an associated (second) fluid supply means arranged to allow the introduction of a fluid into the bore at or below the recess. The recess may be in the form of an annular channel or a part annular channel or channels. The fluid introduced by the second fluid supply means may be the same or different to that introduced by the first fluid supply means, but is conveniently the same.

In accordance with a second aspect of the present invention there is provided a system for controlling the flow of molten metal, the system comprising a nozzle according to any of the above embodiments of the first aspect of the present invention and a stopper rod, configured to be received in the throat region of the nozzle to control the flow of molten metal through the nozzle.

The stopper rod may comprise an elongate substantially cylindrical body with a rounded or frusto-conical nose configured to close the inlet of the nozzle when in contact with the seating surface of the throat region. The stopper rod may include a longitudinal channel through its centre for the supply of a fluid out of its nose. The fluid may be a gas such as argon. The supply of such a fluid out of the stopper rod helps to prevent, in use, the build up of inclusions such as alumina on the stopper rod's nose and also within the nozzle.

The Applicants have found that they can achieve improved flow characteristics by reducing the amount of fluid fed through the stopper rod itself, in certain cases even to zero, and instead using a lower quantity of fluid than would normally be fed through the stopper rod, in the nozzle of the present invention. Thus, the overall fluid consumption of the system can be reduced by the present invention.

In accordance with a third aspect of the present invention there is provided a method of controlling the flow of molten metal through a nozzle of the first aspect, the method comprising flowing molten metal into the nozzle; detaching the flow of molten metal from the inner surface of the nozzle at the channel to create a dead zone; introducing a fluid into the dead zone and allowing the flow of molten metal to draw the fluid down the nozzle to create a barrier between the flow of molten metal and the nozzle.

BRIEF DESCRIPTION OF THE DRAWINGS

Particular embodiments of the present invention will now be described, by way of example only, with reference to the accompanying drawings, in which.

DETAILED DESCRIPTION OF CERTAIN EMBODIMENTS

Figures 1, 1A:
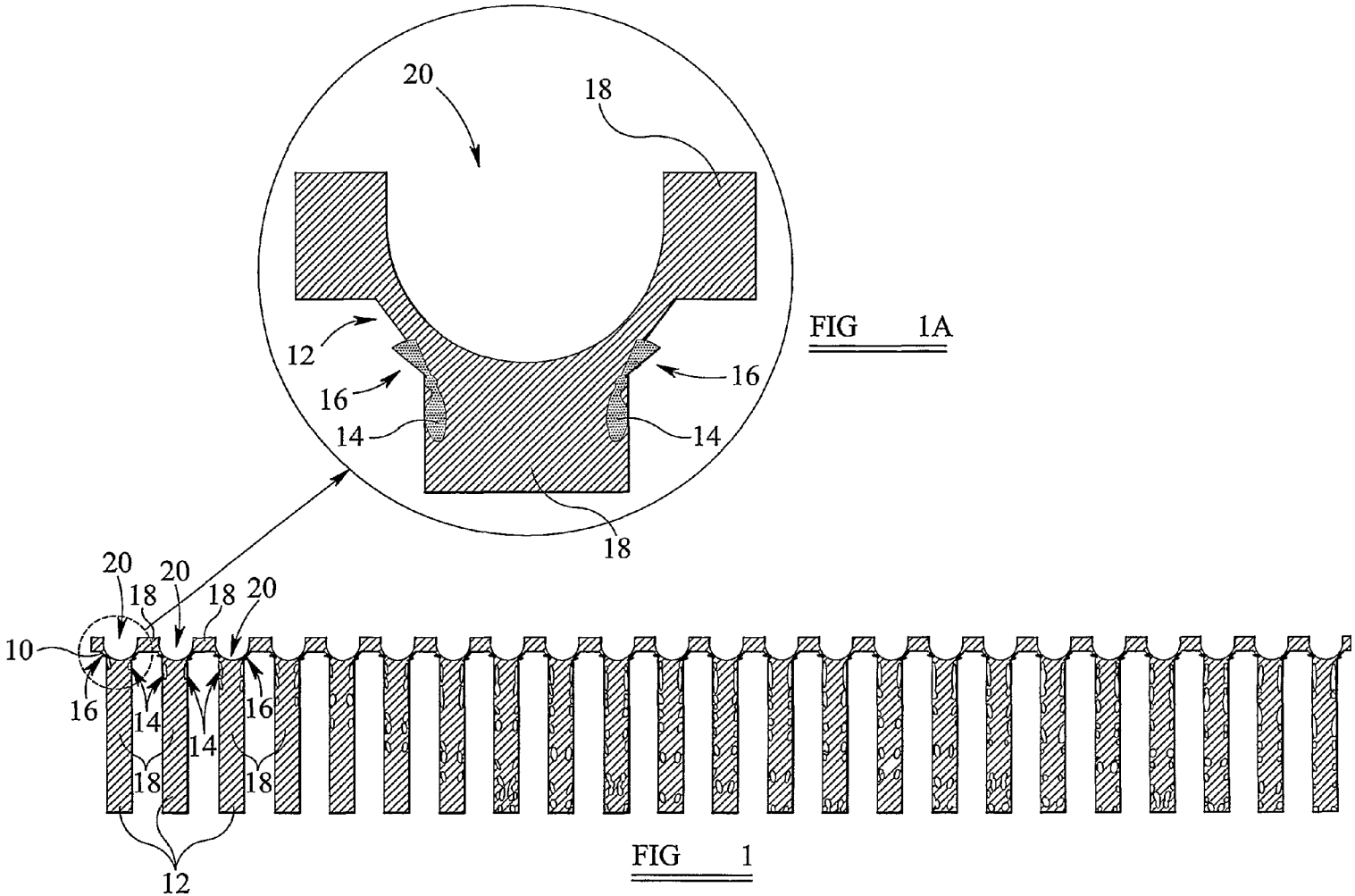
FIG. 1 illustrates the Computational Fluid Dynamics (CFD) modelling results for the sequential phase distribution of molten metal flowing through a nozzle having a frusto-conically shaped throat, in the first few seconds after gas is introduced.
FIG. 1A shows an enlarged view of the throat region of the nozzle modelled in the first view FIG. 1, when gas is first introduced into the nozzle.

As discussed above, FIGS. 1 and 1A show Computational Fluid Dynamics (CFD) modelling results for the sequential phase distribution of molten metal flowing through a nozzle 12 having a frusto-conically shaped throat region 10, in the first few seconds after gas is introduced. This clearly shows that the gas 14 introduced in the bore of the nozzle 12 does not form a continuous protective layer between the inner surface of the nozzle 12 and the molten metal 18 flowing therethrough. Instead, FIG. 1 shows that the gas 14 is prone to disperse into discrete gas pockets as a result of turbulence caused by the molten metal 18 being thrown from the frusto-conical throat 10 towards the centre of the nozzle 12.

Figures 2A, 2B:
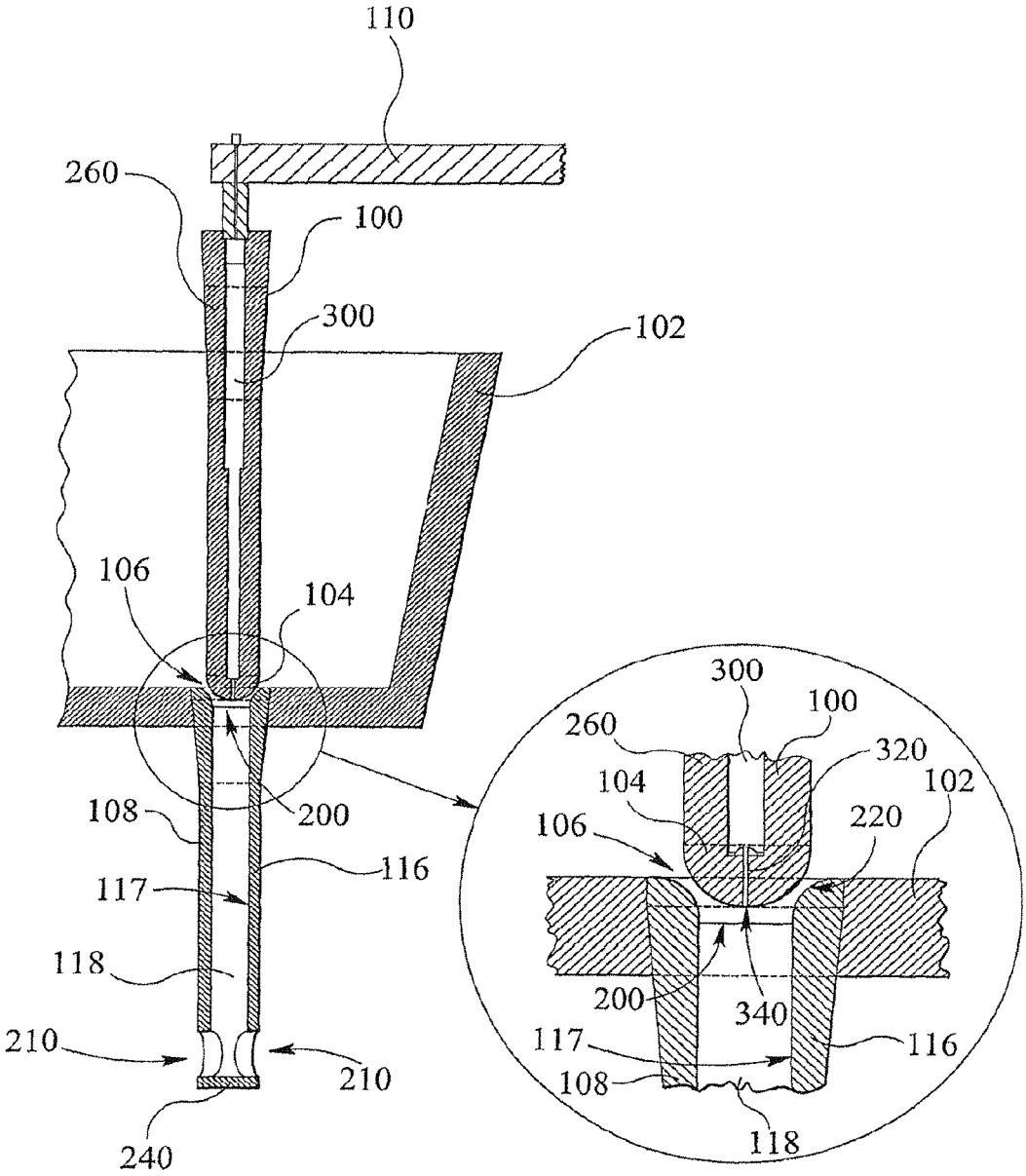
FIG 2A Prior Art
FIG 2B Prior Art
FIG. 2A illustrates, in cross-section, a known casting assembly, in use, in which a stopper rod is positioned in a tundish such that its nose is disposed in the throat of a submerged entry nozzle.
FIG. 2B illustrates an enlarged view of part of the assembly of FIG. 2A, showing the inlet and upper portion of the nozzle and the adjacent nose and lower portion of the stopper rod.

With reference to FIGS. 2A and B, there is illustrated schematically a known casting assembly in which a stopper rod 100 is positioned in a tundish 102 such that its nose 104 is disposed in an inlet 106 of a submerged entry nozzle (SEN) 108. The stopper rod 100 is suspended from a control mechanism 110 such that it can be displaced vertically to control the flow of molten metal from the tundish 102 through the nozzle 108 and into a mould below (not shown).

In the assembly shown, the nozzle 108 is generally in the form of an elongate pipe with a hollow substantially cylindrical sidewall 116, with an inner surface 117 defining a bore 118 therethrough. Towards the top (first end) of the nozzle 108, the sidewall 116 flares outwardly to form a throat region 200 of convex curvature. It will be understood that the inlet 106 constitutes the horizontal plane across the free end of the throat region 200. In addition, an annular portion of the throat region 200 constitutes a seating surface 220, which, in use, serves to seat the stopper rod 100. At the lower (second) end of the nozzle 108 there are two opposed radial outlet ports 210, each having a substantially circular cross-section through the sidewall 116. The base 240 of nozzle 108 is closed.

As shown in FIG. 2B, a known stopper rod 100 is received in the throat region 200. The stopper rod 100 comprises an elongate, generally cylindrical, body 260 with a rounded nose 104 at its lower end. The rounded nose 104 is configured to be received in the inlet 106 such that when the stopper rod 100 is lowered relative to the nozzle 108, the nose 104 will eventually contact the throat region 200 on the annular seating surface 220. This forms a seal which prevents metal flow from passing from the inlet 106 into the bore 118. Lifting the stopper rod 100 relative to the nozzle 108 (as shown in FIG. 1B) creates a gap therebetween though which metal can flow into the nozzle 108. Thus, by altering the vertical displacement of the stopper rod 100 relative to the nozzle 108 it is possible to control the volume of flow through the nozzle 108.

The stopper rod 100, shown in FIGS. 2A and B, also includes a relatively large cylindrical bore 300 through the body 260 and a relatively small cylindrical bore 320 extending from the bore 300 through the nose 104 to a tip 340 of the stopper rod 100. These bores 300, 320 are configured to permit the supply of a fluid, commonly argon gas, through the stopper rod 100. In use, this gas supply helps to prevent inclusions, the presence of which can affect the metal flowing into and through the nozzle 108, from building up on the surface of the nose 104 and the nozzle 108 itself.

It is a well-known problem that during use (in a casting process for steel), inclusions, such as alumina, build up on the inner surface of nozzles such that described above with reference to FIGS. 2A and B. This build up disturbs the flow of molten metal through the nozzle and into a mould below, which, in turn, can degrade the quality of steel cast.

A known attempt to minimise the build up of inclusions within the nozzle comprises providing a porous ring (not shown) within the sidewall 116 and forcing argon gas therethrough. The effectiveness of this approach depends on the distribution of gas emerging into the bore 118. However, it is common for the pores on this type of ring to clog and this results in an uneven and ineffective distribution of gas. In addition, the gas needs to be introduced to the bore 118 at a relatively high pressure so as to be able to force the flow of steel aside to make room for it. This results in a high throughput of gas, which is a costly resource.

Figure 3:
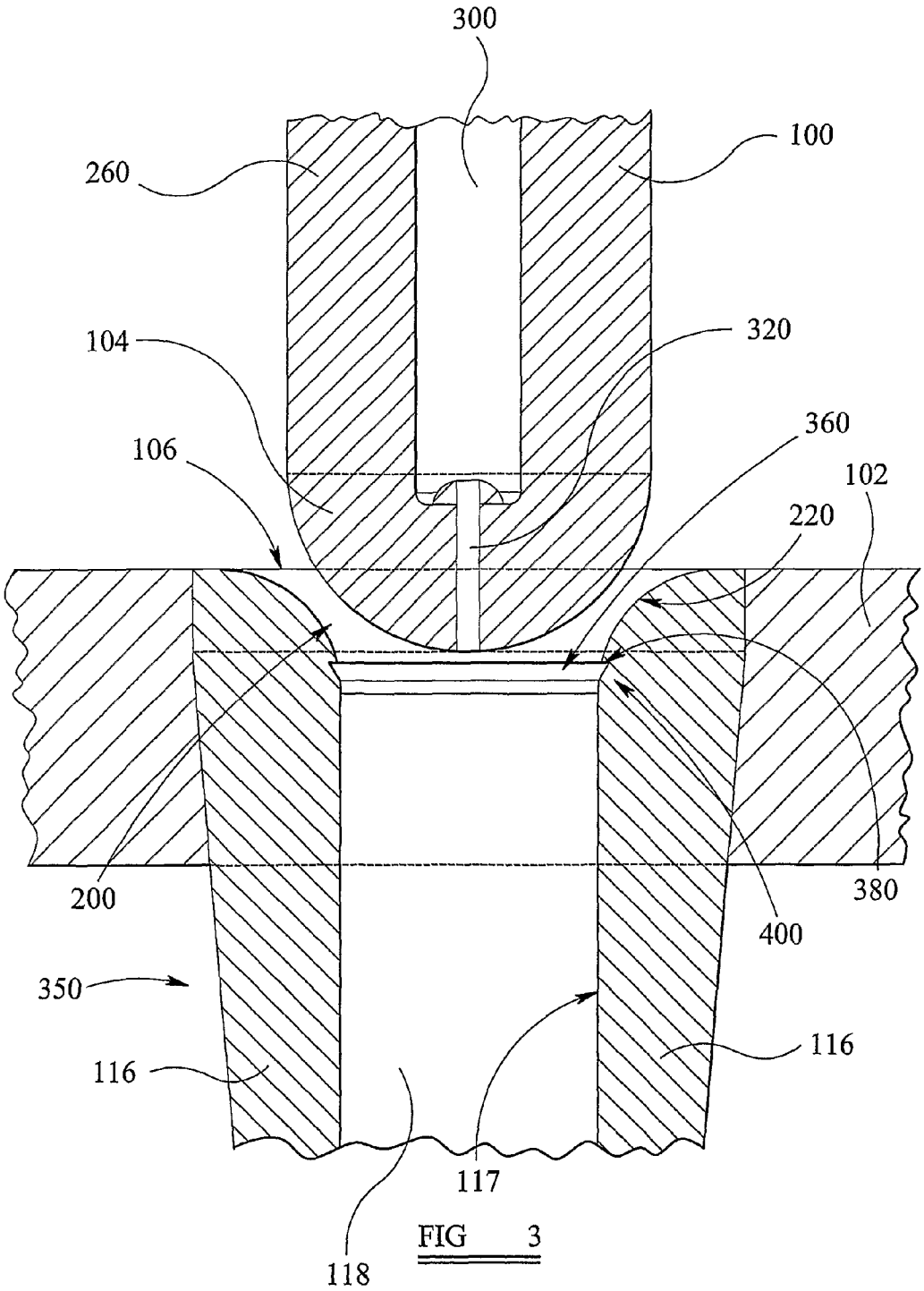
FIG. 3 illustrates the cross-sectional profile of an inlet and upper portion of a nozzle according to an embodiment A of the present invention and an adjacent nose and lower portion of the known stopper rod from FIG. 2A.
Figures 12, 12A, 12B:
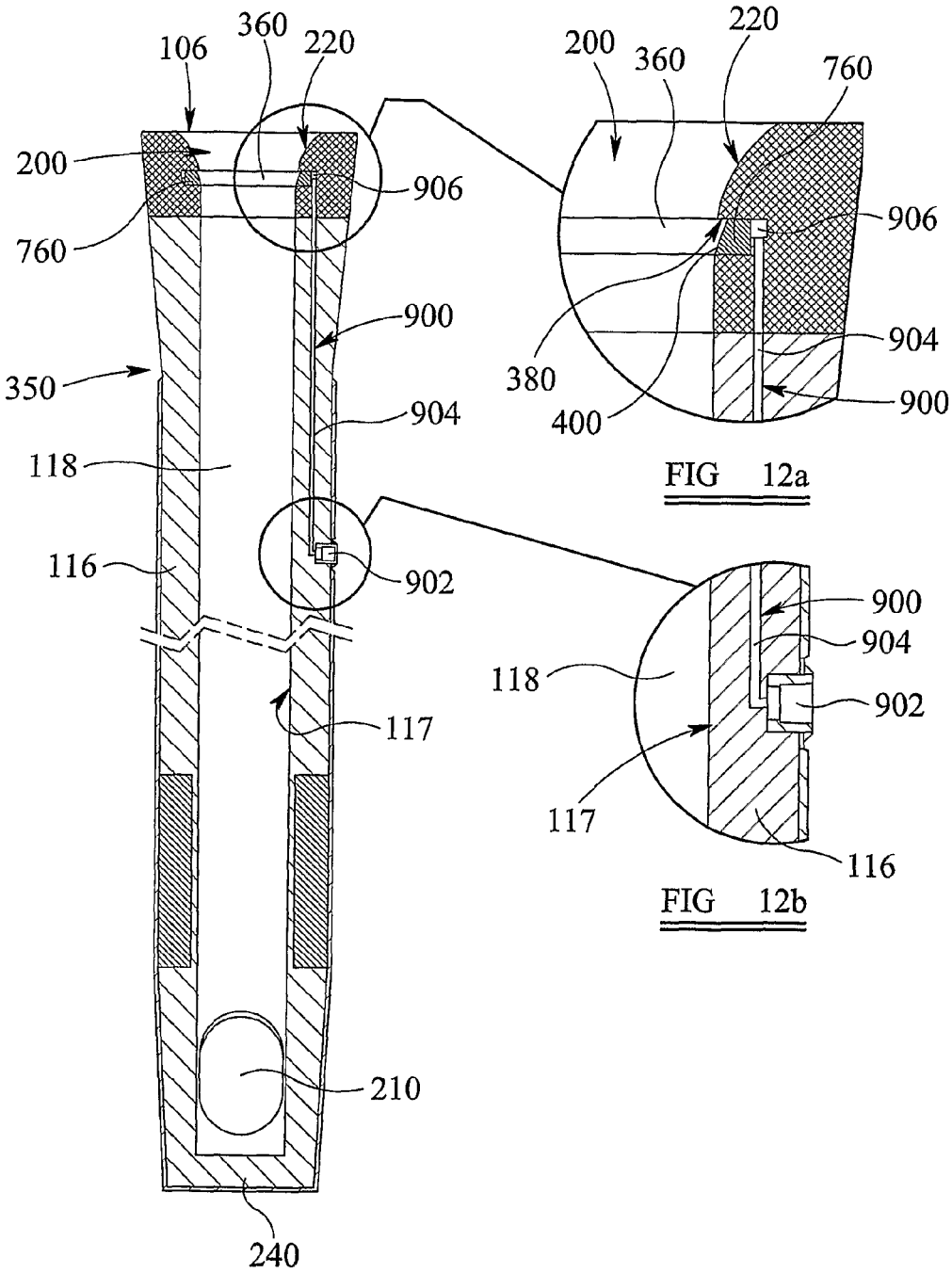
FIG. 12 illustrates a longitudinal cross-sectional view of a nozzle according to an embodiment A" of the present invention—a similar throat region is also illustrated in FIGS. 3 and 7.
FIG. 12A shows an enlarged view of a portion of the throat region of FIG. 12, illustrating the fluid supply means to the annular channel.
FIG. 12B shows an enlarged view of a portion of the bore of FIG. 12, illustrating the inlet for the fluid to enter the fluid supply means.

FIG. 3 illustrates an embodiment A of the present invention, which aims to address the above problems. As can be seen, FIG. 3 shows the same general arrangement of nozzle and stopper rod as described above in relation to FIG. 2B and so like reference numerals will be used where appropriate. The main difference between the prior art nozzle 108 of FIG. 2B and that of the nozzle 350 of embodiment A of FIG. 3 is that an annular channel 360 is provided at the interface of the throat region 200 and the bore 118. The channel 360 in this embodiment is formed by a relatively short radial undercut 380 and a relatively long downwardly and inwardly inclined wall portion 400. The diameter of the bore 118 downstream of the channel 360 is the same as that which would result if the curvature of the throat region 200 continued in place of the channel 360 and terminated at the same point as the wall portion 400. Although not shown in FIG. 3, a passageway is provided through a side of the nozzle 350 to supply, in use, a fluid, i.e. gas (such as argon), to the channel 360. As will be described in more detail below, FIGS. 12, 12A and 12B illustrate a particular arrangement for supplying fluid to the channel 360

Figure 4:
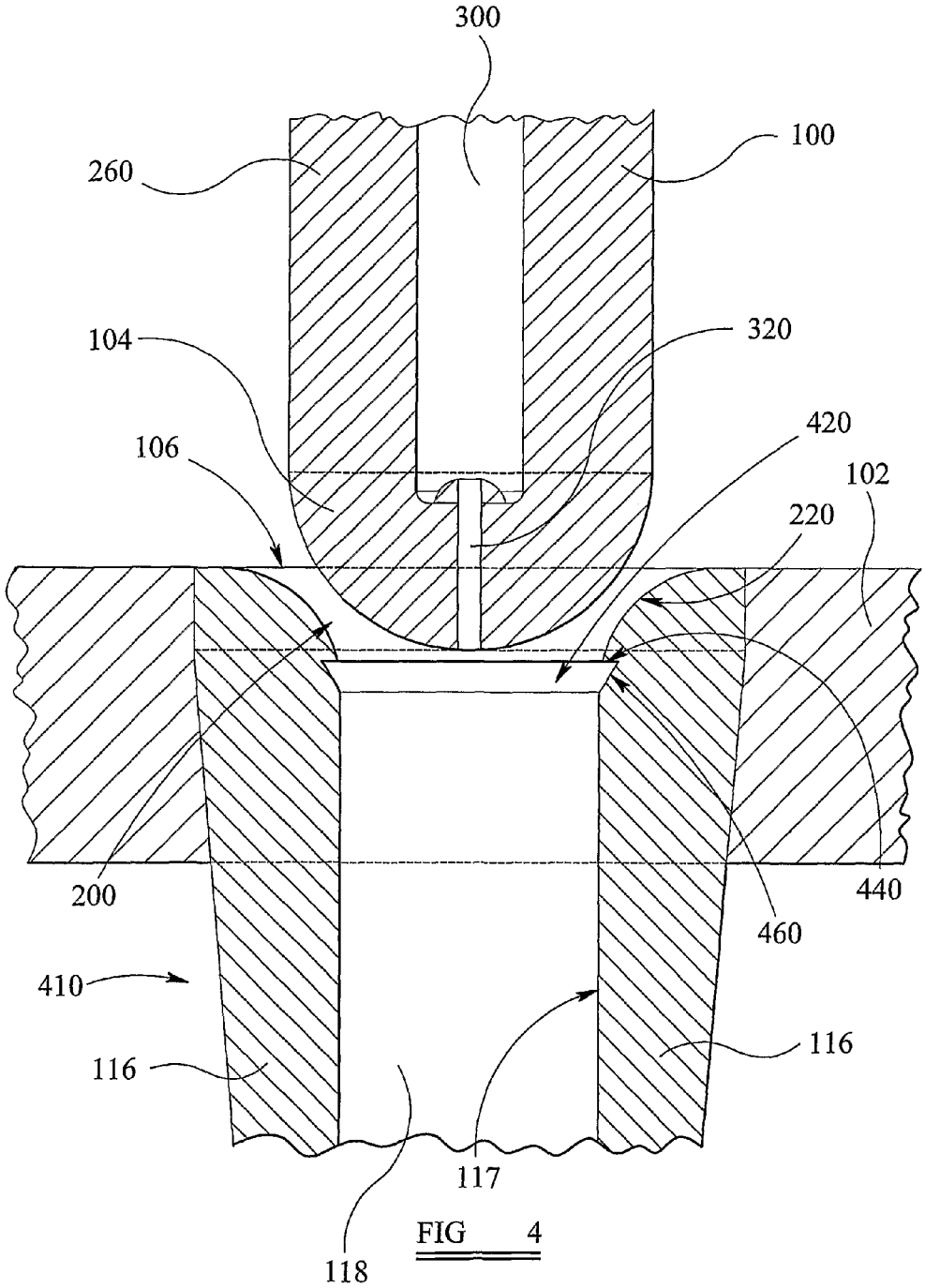
FIG. 4 illustrates the cross-sectional profile of an inlet and upper portion of a nozzle according to an embodiment B of the present invention and an adjacent nose and lower portion of the known stopper rod from FIG. 2A.

FIG. 4 illustrates an embodiment B of the present invention, which shows the same general arrangement of nozzle and stopper rod as described above in relation to FIG. 3 and so like reference numerals will be used where appropriate. The main difference between the nozzle 350 of FIG. 3 and that of the nozzle 410 of embodiment B of FIG. 4 is in the relative dimensions of the annular channels. In particular, the channel 420 in this embodiment is formed by a relatively long radial undercut 440 (approximately three times as long as that in embodiment A). Again, a downwardly and inwardly inclined wall portion 460 is provided from the end of the undercut 44 to the point at which the curvature of the throat region 20 would meet the bore 118 if no channel 420 was provided.

Figure 5:
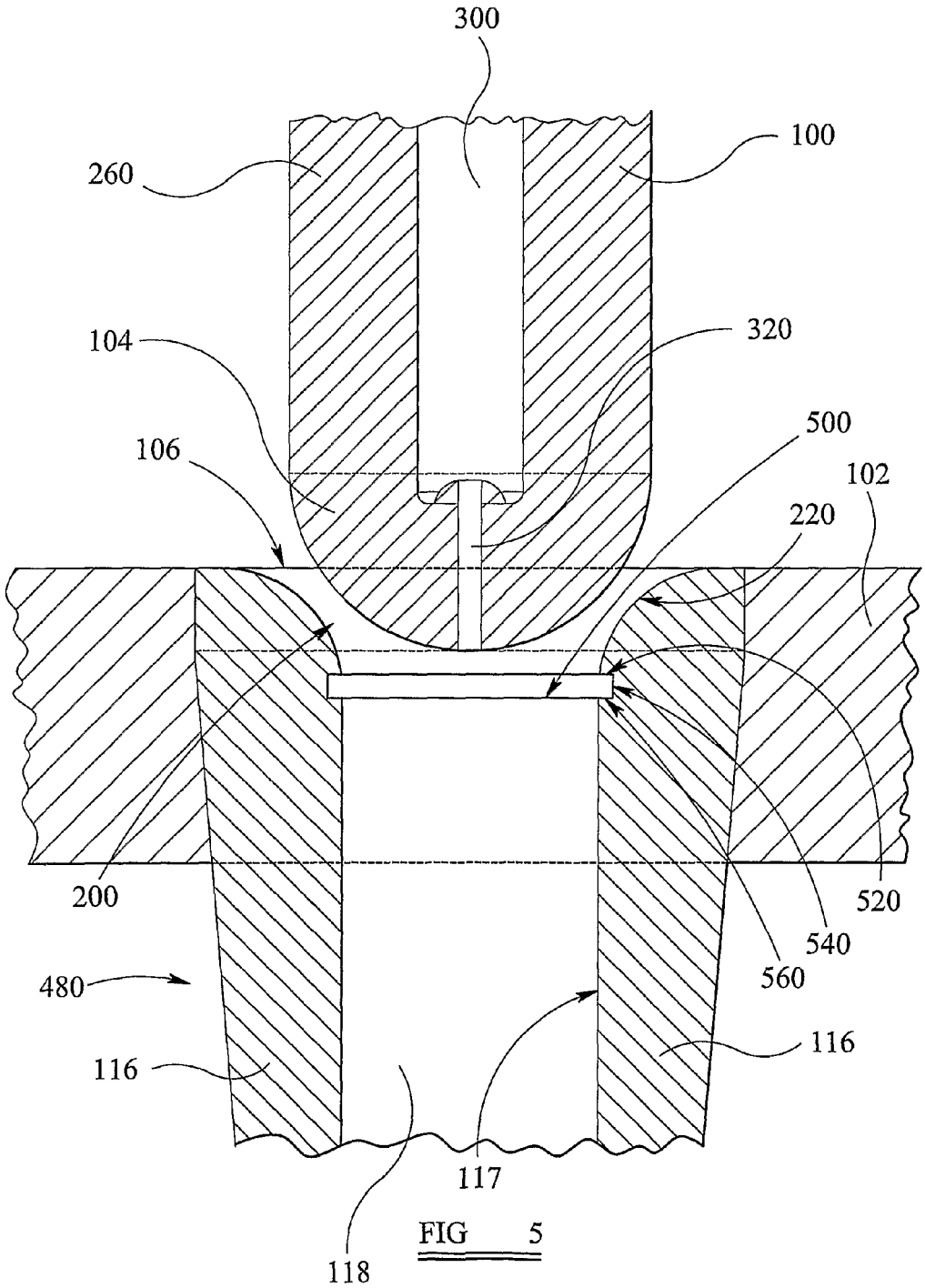
FIG. 5 illustrates the cross-sectional profile of an inlet and upper portion of a nozzle according to an embodiment C of the present invention and an adjacent nose and lower portion of the known stopper rod from FIG. 2A.

FIG. 5 illustrates an embodiment C of the present invention, which shows the same general arrangement of nozzle and stopper rod as described above in relation to FIG. 4 and so like reference numerals will be used where appropriate. The main difference between the nozzle 410 of FIG. 4 and that of the nozzle 480 of embodiment C of FIG. 5 is in the shape of the annular channel 500. In particular, the channel 500 in this embodiment has a rectangular cross-section. Thus, the channel 500 is formed by a radial undercut 520 (approximately half as long as that in embodiment B), a vertically downwardly extending wall portion 540 and a radially inwardly extending wall portion 560.

Figure 6:
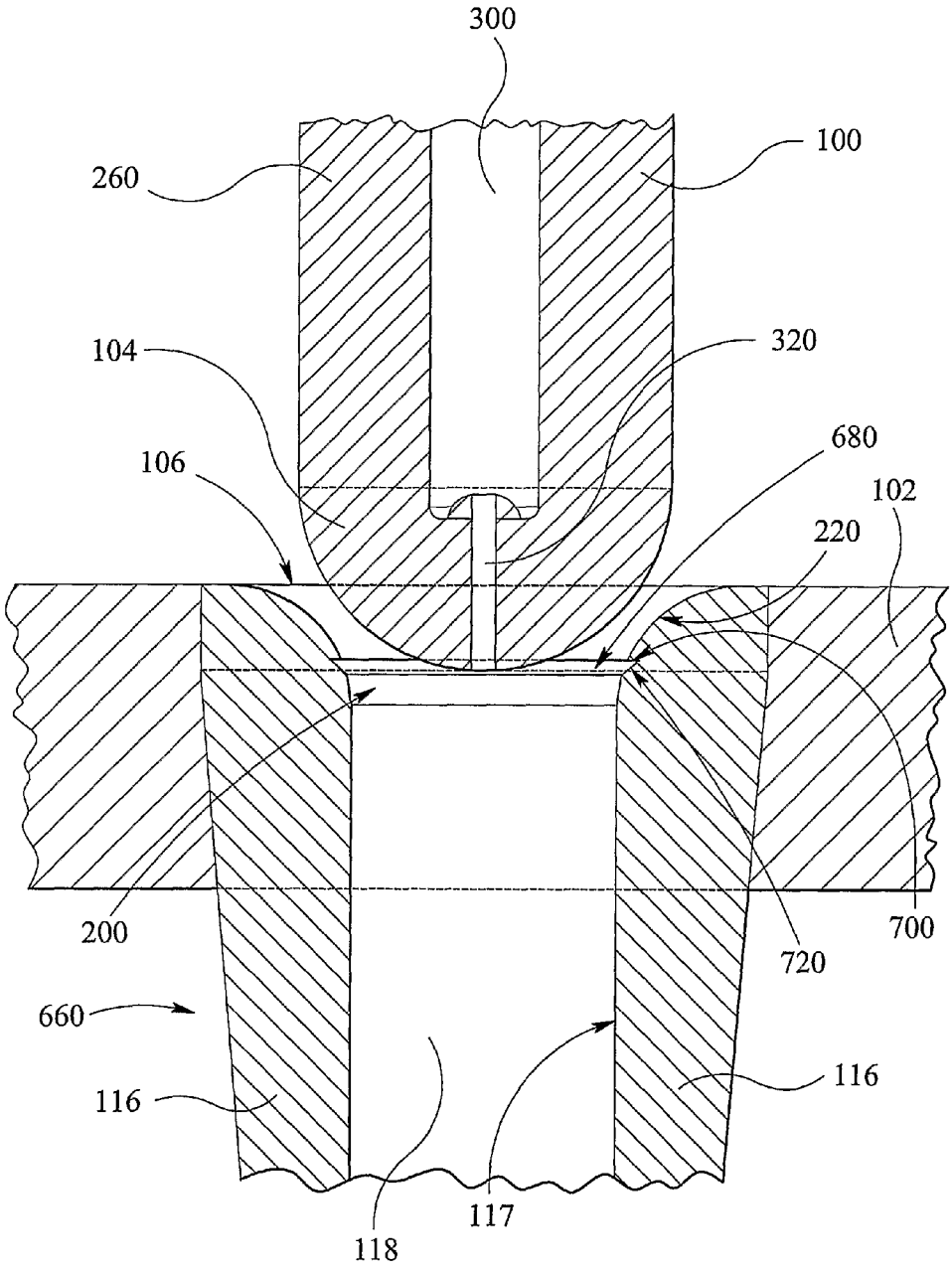
FIG. 6 illustrates the cross-sectional profile of an inlet and upper portion of a nozzle according to an embodiment D of the present invention and an adjacent nose and lower portion of the known stopper rod from FIG. 2A.

FIG. 6 illustrates an embodiment D of the present invention, which shows the same general arrangement of nozzle and stopper rod as described above in relation to FIG. 4 and so like reference numerals will be used where appropriate. The main difference between the nozzle 410 of FIG. 4 and that of the nozzle 660 of embodiment D of FIG. 6 is in the position of the annular channel 680. In particular, the channel 680 in this embodiment is provided approximately midway between the seating surface 220 and the lower end of the throat region 200. The general shape of the channel 680 is the same as that of channel 420 in FIG. 4, however, as the channel 680 is now provided on a curved portion of the nozzle 660, the undercut 700 extends outwardly and slightly downwardly and the wall portion 720 extends more inwardly than downwardly.

Figure 7:
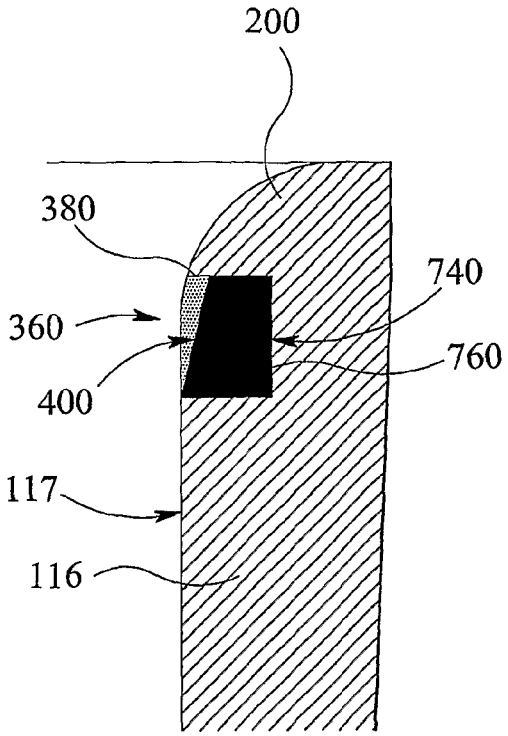
FIG. 7 illustrates the cross-sectional profile of one side of an inlet and upper portion of a nozzle according to an embodiment A' of the present invention.

FIG. 7 illustrates a cross-sectional view of a side of a nozzle showing a particular arrangement to achieve the channel 360 of embodiment A (FIG. 3). As can be seen, a straight-sided groove 740 is initially created in the inner surface 117 of the nozzle, at the position of the desired channel 360. The groove 740 is configured to have the same width as the desired channel 360 but a significantly larger depth (i.e. radial extent). A ceramic porous ring insert 760 is positioned at the base of the groove 740 and co-pressed into the nozzle. The porous ring insert 760 is shaped to fit snugly at the base of the groove 740 with its inwardly exposed face constituting a wall portion of the desired channel. In this particular embodiment the porous ring insert 760 constitutes the downwardly and inwardly inclined wall portion 400 of the channel 360 with an exposed part of the upper side of the groove 740 constituting the undercut 380. The porous ring insert 760 is configured to diffuse gas supplied to it from a gas supply channel (not shown in FIG. 7) into the channel 360.

Figure 8:
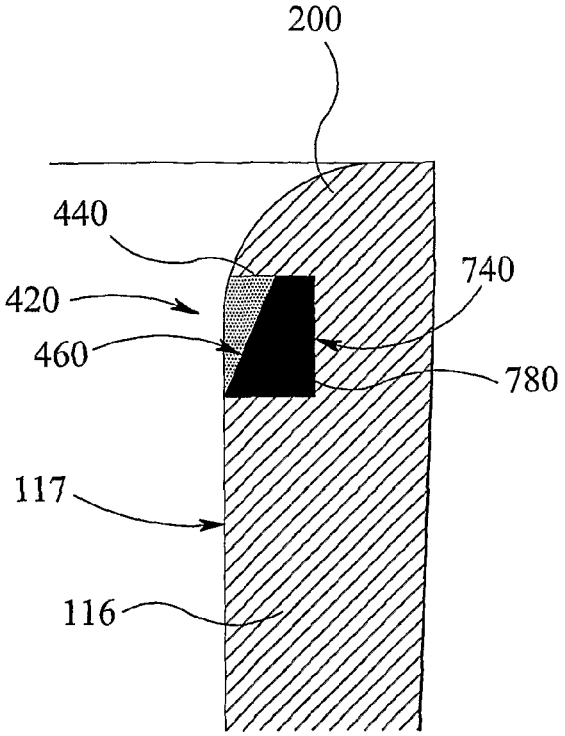
FIG. 8 illustrates the cross-sectional profile of one side of an inlet and upper portion of a nozzle according to an embodiment B' of the present invention.

FIG. 8 illustrates a cross-sectional view of a side of a nozzle showing a particular arrangement to achieve the channel 420 of embodiment B (FIG. 4). The same general arrangement of a channel and porous ring insert as described above in relation to FIG. 7 is employed and so like reference numerals will be used where appropriate. The main difference between the arrangement of FIG. 7 and that of FIG. 8 is in the angle of the exposed face of the porous ring insert 780. In particular, the porous ring insert 780 has a less steeply inclined exposed face, relative to the horizontal, which constitutes the downwardly and inwardly inclined wall portion 460 of the channel 420 of embodiment B. As above, an exposed part of the upper side of the groove 740 constitutes the undercut 440. However, in this embodiment the undercut 440 is significantly larger than that in embodiment A.

Figure 9:
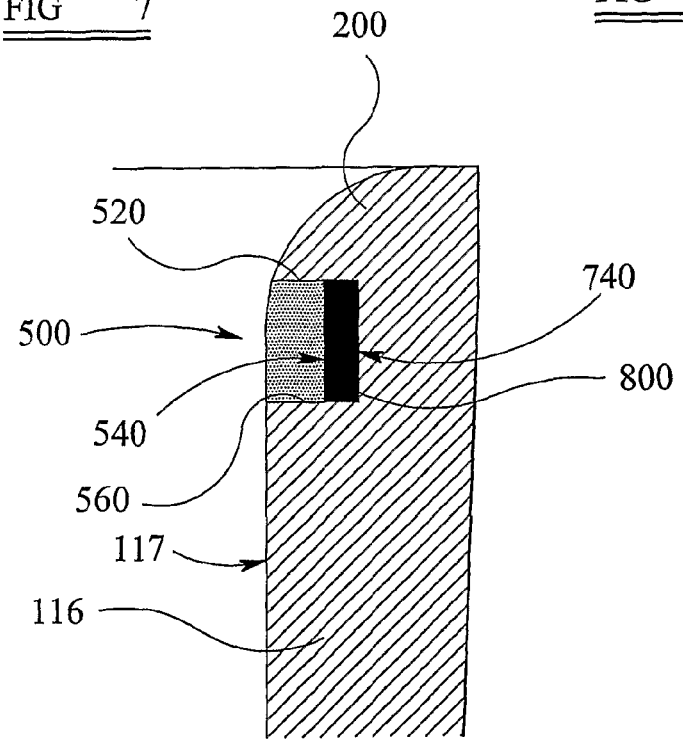
FIG. 9 illustrates the cross-sectional profile of one side of an inlet and upper portion of a nozzle according to an embodiment C' of the present invention.

FIG. 9 illustrates a cross-sectional view of a side of a nozzle showing a particular arrangement to achieve the channel 500 of embodiment C (FIG. 5). The same general arrangement of a channel and porous ring insert as described above in relation to FIG. 8 is employed and so like reference numerals will be used where appropriate. The main difference between the arrangement of FIG. 8 and that of FIG. 9 is the shape of the channel created by the exposed face of the porous ring insert 800. In particular, the porous ring insert 800 has a vertical exposed face set back within the recess 740 to constitute the vertical wall portion 540 of the channel 500 of embodiment C. As previously, an exposed part of the upper side of the recess 740 constitutes the undercut 520. In addition, an exposed part of the lower side of the recess 740 constitutes the radially inwardly extending wall portion 560. Thus, in this embodiment the channel is substantially rectangular in shape as opposed to triangular in shape (as per embodiments A and B).

In use, the above embodiments allow molten metal to flow along the throat region of the nozzle until it is thrown off the curved surface of the throat due to the presence of the channel. This creates a 'dead zone' in the region of the channel where substantially no metal flows. Downstream of the 'dead zone' the flow of metal naturally tends to expand to fill the bore and would re-attach itself to the inner surface of the nozzle if it were not for a gas (argon) introduced via the passageway to the channel. The argon fed into the bore in the region of the 'dead zone' is brought down the inner surface of the bore by the flow of molten metal therethrough. Thus, the argon forms a sleeve or curtain between the bore and the flow, of metal, which helps to prevent the metal from re-attaching to the surface of the nozzle and thereby reduces the build-up of inclusions such as alumina on the surface of the nozzle. In some embodiments, the length of the curtain can be made to oscillate in order to provide a scrubbing effect to minimise the build-up of inclusions. Since the argon is introduced into a 'dead zone' it can be introduced at a lower rate and pressure than if it were to be introduced directly into the stream of metal. Accordingly, substantial savings can be made on the amount of argon required.

It will be understood that the same effect can be achieved if the argon is supplied to the bore at a position adjacent to or below the channel but before the point of re-attachment of the stream of metal to the inner surface of the nozzle.

Figure 10A:
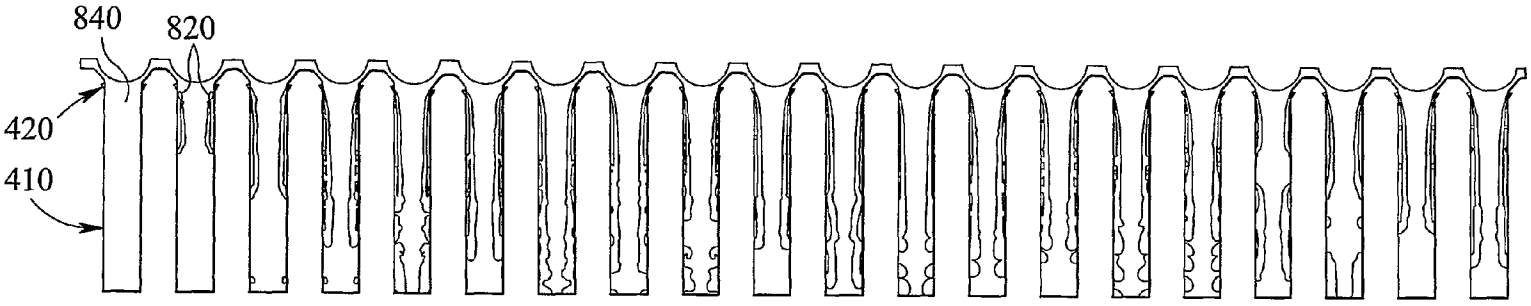
FIGS. 10A, B and C illustrate respectively Computational Fluid Dynamics (CFD) modelling results for the sequential phase distribution, velocity and pressure of molten metal flowing through a nozzle according to an embodiment B of the present invention, in the first 20 seconds after gas is introduced.

FIGS. 10A, B and C illustrate respectively Computational Fluid Dynamics (CFD) modelling results for the sequential phase distribution, velocity and pressure of molten metal flowing through a nozzle 410 according to an embodiment B (illustrated in FIGS. 4 and 8) of the present invention in the first 20 seconds after argon gas is introduced.

In this particular study, a simple open-ended nozzle (i.e. having an axial outlet of equal diameter to the bore) was employed. Thus, within the nozzle molten metal was allowed to freefall under gravity—the control of flow through the nozzle being solely achieved by the degree of closure of the stopper rod. Accordingly, the modelling results would apply equally to other arrangements of outlet ports, which would be chosen according to the flow characteristics desired in the mould.

With reference to FIG. 10A it can be seen that argon gas injected via the channel 420 is brought down the sides of the nozzle 410 by the flow of molten metal 840 to form a protective curtain 820. As the curtain 820 approaches the end of the nozzle 410 the pressure of the molten metal 840 tends to increase and this causes the curtain to disperse. This is desirable because it helps to prevent large plumes of gas, which can cause turbulence in the mould, from exiting the nozzle.

It can also be seen from FIGS. 10A, B and C that the curtain 820 may not be stable in some embodiments and, in fact, an unstable curtain 820 (i.e. one which oscillates up and down the nozzle 410) may actually result in a cleaner nozzle surface since the oscillation will produce a scrubbing effect on the inner surface of the nozzle 410.

Figure 10B:
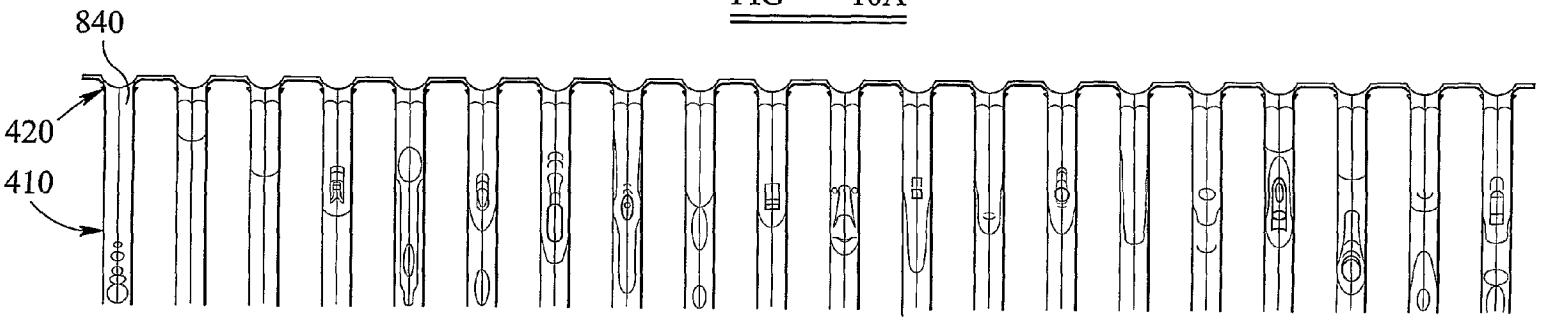
Figure 10C:
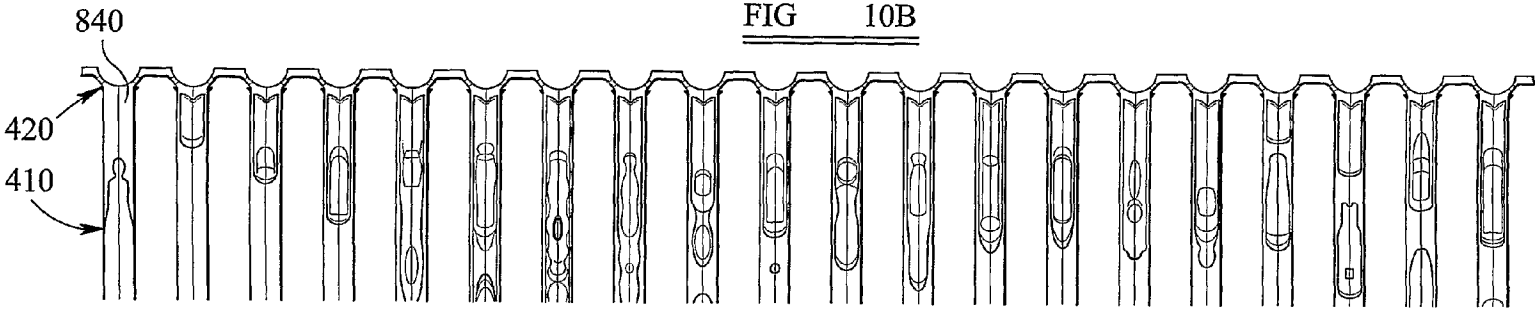

In order to reduce turbulence in the mould, it is desirable that some of the energy in the flow of metal 840 be dissipated before it exits the nozzle 410. This can be achieved by ensuring that the flow 840 does not exit the nozzle 410 at its peak velocity. As shown in FIG. 10B, the region of highest velocity is generally found towards the centre of the bore and not near the end of the nozzle 410.

Comparing FIGS. 10B (velocity) and 10C (pressure) it can be seen that, in this embodiment, the region of highest pressure in the flow generally occurs downstream of the region of highest velocity but, still, it should be noted that the region of highest pressure is not generally adjacent the end of the nozzle 410.

Figure 11A:
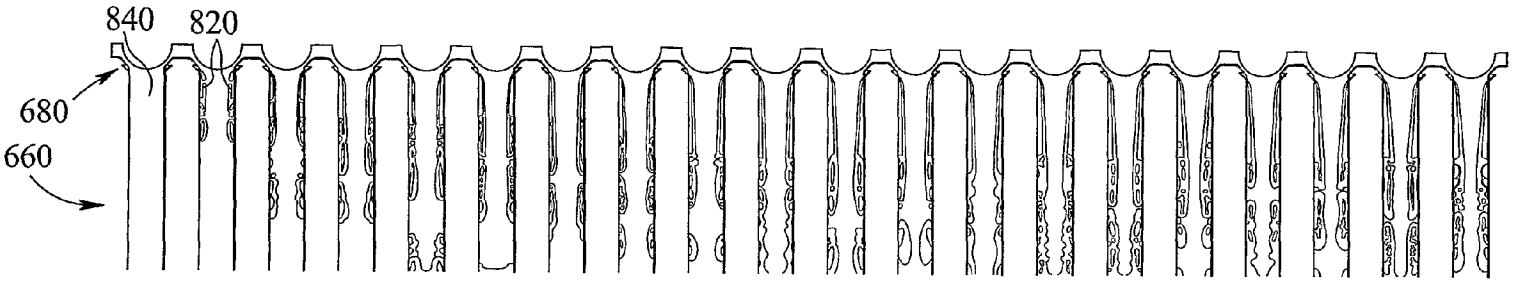
FIGS. 11A, B and C illustrate respectively Computational Fluid Dynamics (CFD) modelling results for the sequential phase distribution, velocity and pressure of molten metal flowing through a nozzle according to an embodiment D of the present invention, in the first 20 seconds after gas is introduced.
Figure 11B:
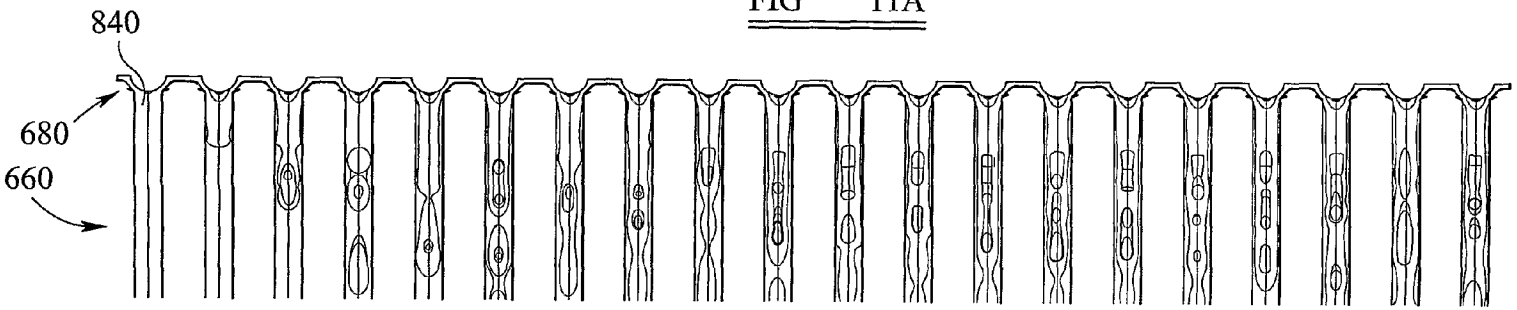
Figure 11C:
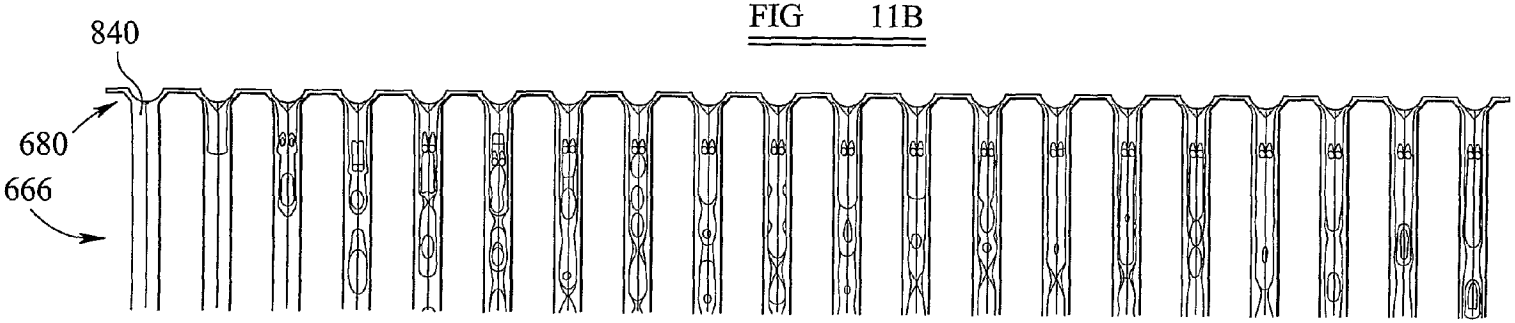

FIGS. 11A, B and C illustrate respectively Computational Fluid Dynamics (CFD) modelling results for the sequential phase distribution, velocity and pressure of molten metal flowing through a nozzle 660 according to an embodiment D (illustrated in FIG. 6) of the present invention in the first 20 seconds after argon gas is introduced.

The results shown are substantially similar to those described above in relation to FIGS. 10A, B and C but as the channel 680 in this case is mounted further up the throat 200 of the nozzle 660, the curtain 820 begins at a higher relative position and tends to break up at a higher relative position.

The above modelling results were obtained based on a gas supply rate of 4 liters per minute through the nozzle and with no gas supply through the stopper rod. This represents a significant reduction in gas consumption over the current practise, which normally requires 8 liters per minute through the stopper rod.

FIG. 12 illustrates a longitudinal cross-sectional view of a nozzle according to an embodiment A" of the present invention, which has the same general form of the nozzle described above in relation to FIGS. 3 and 7 and so like reference numerals will be used where appropriate. The main difference between the nozzle 350, shown in FIG. 3 and that shown in FIGS. 12, 12A and 12B is that the fluid supply means 900 to the annular channel 360 is now illustrated. The fluid supply means 900 comprises an inlet 902 in the outer surface of the nozzle 350 (configured for the introduction of fluid into the nozzle 350), a vertical passageway 904 extending upwardly from the inlet 902, through the sidewall 116, to an annular passageway 906 disposed around the outer edge of the ceramic porous ring insert 760 which forms the outer wall of the annular channel 360, as described in relation to FIG. 7. Thus, in use, a fluid (usually argon gas) can be supplied into the bore 118 by flowing it through the inlet 902, along the vertical passageway 904, around the annular passageway 906, and through the porous ring 760 into the annular channel 360.

A further embodiment of the present invention (not shown) comprises a channel that is formed by a generally outwardly extending undercut and a generally downwardly extending wall portion that continues to the end of the nozzle. Thus, the width of the bore downstream of the undercut remains substantially constant and greater than the width of the bore immediately upstream of the undercut. Alternatively, the width of the bore downstream of the undercut may increase or it may decrease to a point that is still greater than that immediately upstream of the undercut. The main advantage of these particular embodiments is that the stream of molten metal has to expand further than normal to re-attach itself to the inner surface of the nozzle. This will take longer to achieve than previously and so it is more likely that the argon curtain formed will remain in tact further down the nozzle.

The various embodiments of the present invention have a number of advantages. In particular, they allow for a consistent flow of metal into a mould, a prolonged nozzle lifetime, an improved quality of steel, higher productivity and less consumption of argon.

It will be appreciated by persons skilled in the art that various modifications may be made to the above-described embodiments without departing from the scope of the present invention. In particular, features of two or more described embodiments may be combined in a single embodiment.

The invention claimed is:

1. A nozzle for guiding molten metal comprising:

an inlet at an upstream first end;

at least one outlet towards a downstream second end;

an inner surface between said inlet and said at least one outlet defining a bore through the nozzle; the bore having a throat region adjacent the inlet;

an annular channel provided in the inner surface of the nozzle in direct communication with the bore; and a fluid supply means arranged to introduce fluid into the bore via the annular channel or downstream thereof;

said throat region having a convexly curved surface and said annular channel being located within or adjacent the convexly curved surface of the throat region;

whereby molten metal flowing into the throat region is thrown off the inner surface of the nozzle due to the presence of the annular channel.

2. A nozzle according to claim 1, wherein the channel is located within the convexly curved surface of the throat region.

3. A nozzle according to claim 1, wherein the throat region has a seating surface, which contacts a stopper rod in use to stop the flow of molten metal through the nozzle, and wherein the channel is positioned downstream of the seating surface.

4. A nozzle according to claim 1, wherein the width of the channel is within a range of approximately 0.5% to 95% of the distance between the first and second ends of the nozzle.

5. A nozzle according to claim 1, wherein the width of the channel is no more than 5% of the distance between the first and second ends of the nozzle.

6. A nozzle according to claim 1, wherein the depth of the channel is within a range of approximately 0.1% to 50% of the thickness of the nozzle at the point immediately upstream of the channel.

7. A nozzle according to claim 1, wherein the curved surface immediately upstream of the channel has a tangential plane that forms an angle of between 0° and 50° when measured with respect to the longitudinal axis of the bore.

8. A nozzle according to claim 1, wherein the curved surface immediately upstream of the channel has a tangential plane that forms an angle of between 0° and 5° when measured with respect to the longitudinal axis of the bore.

9. A nozzle according to claim 1, wherein the fluid supply means comprises a porous block which constitutes at least one wall portion of the channel or a portion of the inner surface adjacent or downstream of the channel and which is configured to diffuse fluid therethrough.

10. A nozzle according to claim 1, wherein the diameter of the bore of the nozzle downstream of the channel is equal to or greater than the diameter of the bore immediately upstream of the channel.

11. A nozzle according to claim 1, wherein the channel is constituted by a number of mutually spaced part-annular channels, wherein the sum of the spacings between the part-annular channels is less than 50% of the sum of the lengths of the part-annular channels.

12. A nozzle according to claim 1, wherein the throat region has an axial extent of 3 to 10% of the distance between the first and second ends of the nozzle.

13. A system for controlling the flow of molten metal, the system comprising a nozzle according to claim 1 and a stopper rod configured to be received in the throat region of the nozzle to control the flow of molten metal through the nozzle.

14. A method of controlling the flow of molten metal through a nozzle according to claim 1, the method comprising flowing metal into the nozzle; detaching the flow of metal from the inner surface of the nozzle at the channel to create a dead zone; introducing a fluid into the dead zone and allowing the flow of metal to draw the fluid down the nozzle to create a barrier between the flow of metal and the nozzle.

15. The method according to claim 14 wherein the fluid is argon gas.

* * * * *